United States Patent [19]

Lodwig et al.

[11] Patent Number: 4,514,011

[45] Date of Patent: Apr. 30, 1985

[54] POWER AND LIQUID SUPPLY SYSTEM FOR MINING MACHINES

[75] Inventors: Klaus Lodwig, Bochum; Friedhelm Schefers, Dortmund-Brackel, both of Fed. Rep. of Germany

[73] Assignee: Gebr. Eickhoff Maschinenfabrik und Eisengiesserei m.b.H., Bochum, Fed. Rep. of Germany

[21] Appl. No.: 514,301

[22] Filed: Jul. 15, 1983

[30] Foreign Application Priority Data

Aug. 12, 1982 [DE] Fed. Rep. of Germany ..... 3229989

[51] Int. Cl.[3] ..... E21C 27/34

[52] U.S. Cl. ..... 299/42; 191/12 R; 104/194

[58] Field of Search ..... 299/42, 43, 44, 45, 299/53, 34, 12; 104/194 X, 146, 155, 156; 191/12 R X

[56] References Cited

U.S. PATENT DOCUMENTS

| | | | |
|---|---|---|---|
| 2,858,381 | 10/1958 | Goldberg et al. | 191/12 R |
| 3,231,850 | 1/1966 | Kilburg | 191/12 R |
| 3,339,981 | 9/1967 | Dommann et al. | 299/34 |
| 3,345,471 | 10/1967 | Kilburg | 191/12 R |
| 3,861,751 | 1/1975 | Erwien | 299/34 |
| 4,025,118 | 5/1977 | Lanfermann et al. | 299/43 |
| 4,072,355 | 2/1978 | Pentith | 299/12 |

*Primary Examiner*—Stephen J. Novosad
*Assistant Examiner*—Mark J. DelSignore
*Attorney, Agent, or Firm*—Thomas H. Murray

[57] ABSTRACT

An electrical power supply and liquid supply arrangement for a mining machine, particularly a longwall mining machine, wherein extended lengths of a power supply cable and liquid supply conduit are disposed within a housing structure extending along one side of the course of travel of the mining machine. A side arm on the mining machine extends through a slot in a face plate of the housing structure and carries at its outer end a junction box within which power cables leading from the mining machine can be connected to or disconnected from an external power cable. Clamped to the aforesaid junction box is the liquid supply conduit which can be selectively coupled to, or uncoupled from, a mating supply conduit leading to the interior of the mining machine. The arrangement permits connection or disconnection of the power supply and water supply members to or from the mining machine without any disassembly of the machine itself.

9 Claims, 6 Drawing Figures

POWER AND LIQUID SUPPLY SYSTEM FOR MINING MACHINES

BACKGROUND OF THE INVENTION

The present invention relates in general to mining machines, and more particularly to longwall mining machines of the type having a housing structure extending along one side of the course of travel of the machine, together with a side arm on the mining machine which extends through a slot in the housing structure for supporting and guiding power cables and a liquid supply conduit for the machine.

A mining machine of the aforesaid type is shown, for example, in U.S. Pat. No. 4,025,118. By reference to that patent, it will be seen that it discloses a housing structure which extends along one side of the course of travel of a long-wall mining machine, the housing structure having an internal space which accommodates at least a portion of an extended length of power cable for the mining machine. The housing assembly includes a face plate having a longitudinal slot extending along the length of the housing and facing toward the mining machine. A side arm on the mining machine extends through the slot and supports a length of the power cable extending through the slot in the face plate, this latter length of cable being connected to power supply terminals within the mining machine itself.

Power supply cables of the type described above, particularly when they are used without any cable chain, are subjected to heavy wear even when they are disposed inside the aforesaid housing structure. This wear arises from movement of the cable which is dragged along inside the housing assembly as the mining machine moves back and forth and because of the very narrow radius of curvature of the cable loop, the height of the loop being determined by either the diameter of the roller of a cable trolley or, in the absence thereof, by the limited height inside the housing assembly. In this respect, the curved portion of the cable loop, and particularly that portion in the entry zone where the cable enters the machine, suffer severe deformation of the cable sheathing with the eventual result of damage due to the strong pull exerted in this zone and because of twisting of the cable. As a result, when cable wear becomes excessive, either the cable has to be shortened by an amount equal to the length of the worn part or the complete cable has to be replaced. Work of this type underground is labor intensive and time consuming since the cable extends into the interior of the machine body and into an airtight chamber where the various cable strands are connected to terminals. As a consequence, any shortening or replacement of the cable caused by wear requires assembly work on or in the mining machine, an operation which is dangerous since it must be carried out within the range of machine movement.

SUMMARY OF THE INVENTION

In accordance with the present invention, the disadvantages of prior art power supply cables described above are obviated; and, additionally, means are provided for readily connecting or disconnecting a liquid supply conduit to the mining machine.

Specifically, there is provided, in a mining machine arrangement, a housing structure which extends along one side of the course of travel of the machine on the side thereof opposite the mineral being cut. The interior of the housing structure accommodates at least portions of the extended lengths of both a power supply cable and a liquid supply conduit. The housing structure is provided with a face plate having an elongated slot extending along the course of travel of the mining machine. A side arm on the mining machine extends through the slot; while a junction box is carried on an end of the side arm within the interior of the housing structure. Junction means are provided within the box for connecting a power cable leading from the mining machine to the aforesaid extended length of power cable in the interior of the housing structure. At the same time, coupling means are carried by the arm for coupling a liquid supply conduit leading from the mining machine to the aforesaid extended length of liquid supply conduit in the interior of the housing structure. With an arrangement of this sort, a damaged cable can be disconnected from the cable leading to the aforesaid junction box, making it unnecessary to perform any assembly or disassembly operations on the mining machine itself. The same is true of the liquid supply cable. That is, it can be connected or disconnected at a point removed from the interior of the mining machine, without disrupting the mining machine itself.

In one embodiment of the invention, the side arm is mounted on the mining machine for pivotal movement about a vertical axis. When the resistance which opposes movement of the side arm within the aforesaid elongated slot exceeds a critical value, the arm pivots; and this pivotal movement actuates a limit switch which stops the mining machine and prevents damage to the housing structure and/or the junction box which moves within it.

In another embodiment of the invention, the junction box carried on the side arm within the housing structure is provided with guide elements or rollers which engage tracks to guide the junction box within the housing structure and prevent damage to the same. To prevent any excessive strain between the mining machine and the housing structure, it is necessary to provide a side arm which is rigidly secured to the junction box, which is connected to the mining machine body for limited movement transversely of the direction of machine movement, and which is pivotal on the mining machine around a shaft which extends parallel to the floor in the direction of machine movement. A movable arm of this type helps to compensate for any variations in length between the path traveled by the machine and the path traveled by the junction box inside the housing structure.

Preferably, beneath the junction box is a liquid supply conduit clamping means which clamps the extended length of hose within the housing structure. Beyond the clamping means is a liquid coupling by which the hose can be disconnected from a length of hose leading into the mining machine proper.

In the usual case, the power supply cable comprises an outer sheathing which carries a plurality of electrical conductors, usually three in number. The sheathing for the cable terminates at the junction box within the housing structure; and the conductors which it carries extend between the terminals of the junction box and the mining machine proper. In this way, the sheathing, which is bulky, need not extend between the junction box and the mining machine; and the dimensions of the side arm which carries the junction box can be reduced considerably. Since, for reasons of stability, the side arm should have maximum dimensions horizontally, the discrete conductors of the power cable and the hose for water used for cooling and/or trickling can be readily placed one beside the other inside the side arm. This reduces the vertical height of the arm as well as the height of the elongated slot in the housing structure which can be closed readily and reliably by rubber strips which separate to permit passage of the side arm.

The above and other objects and features of the invention will become apparent from the following detailed description taken in connection with the accompanying drawings which form a part of this specification, and in which.

Figure 1:
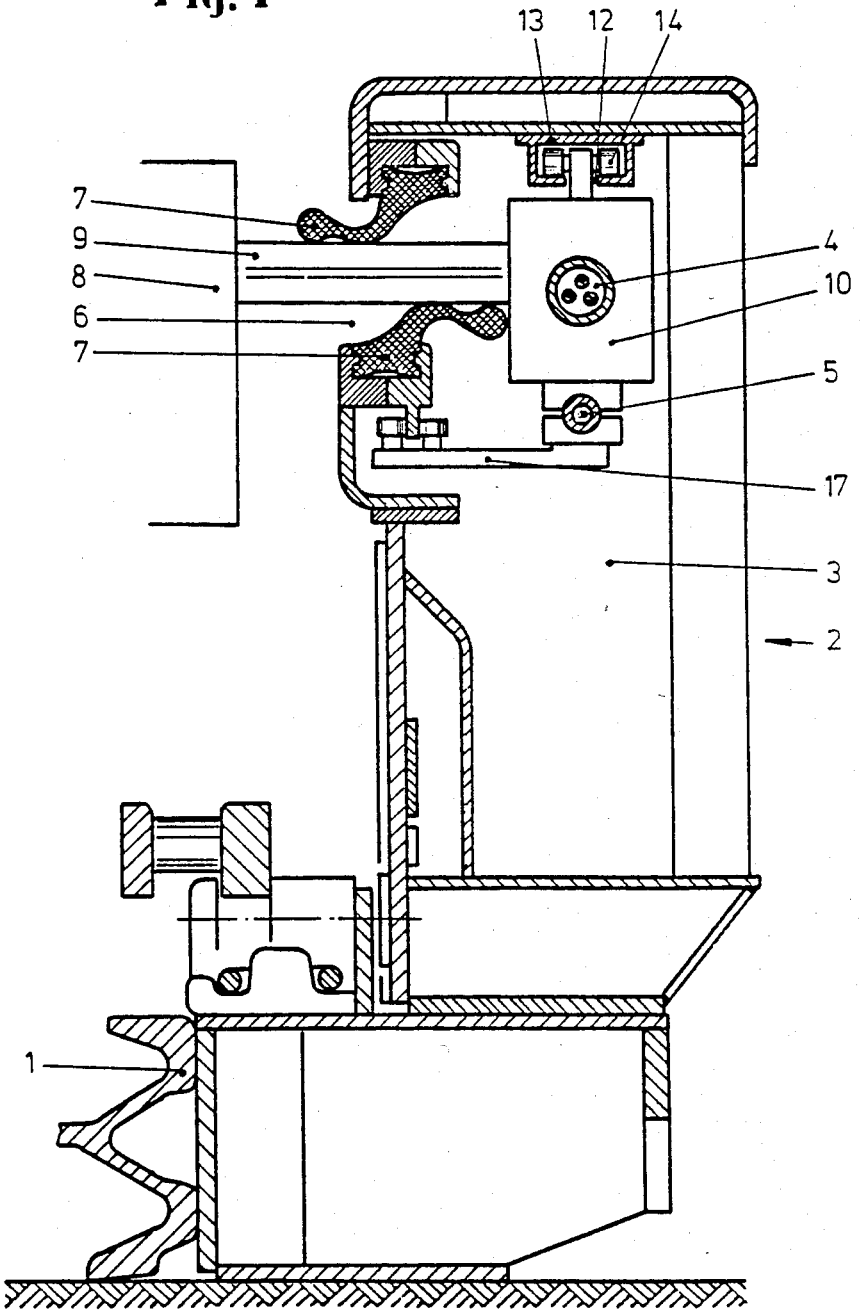
FIG. 1 is a cross-sectional view of a housing structure extending along the path of travel of a longwall mining machine, showing the location of the junction box of the invention therein.
Figure 2:
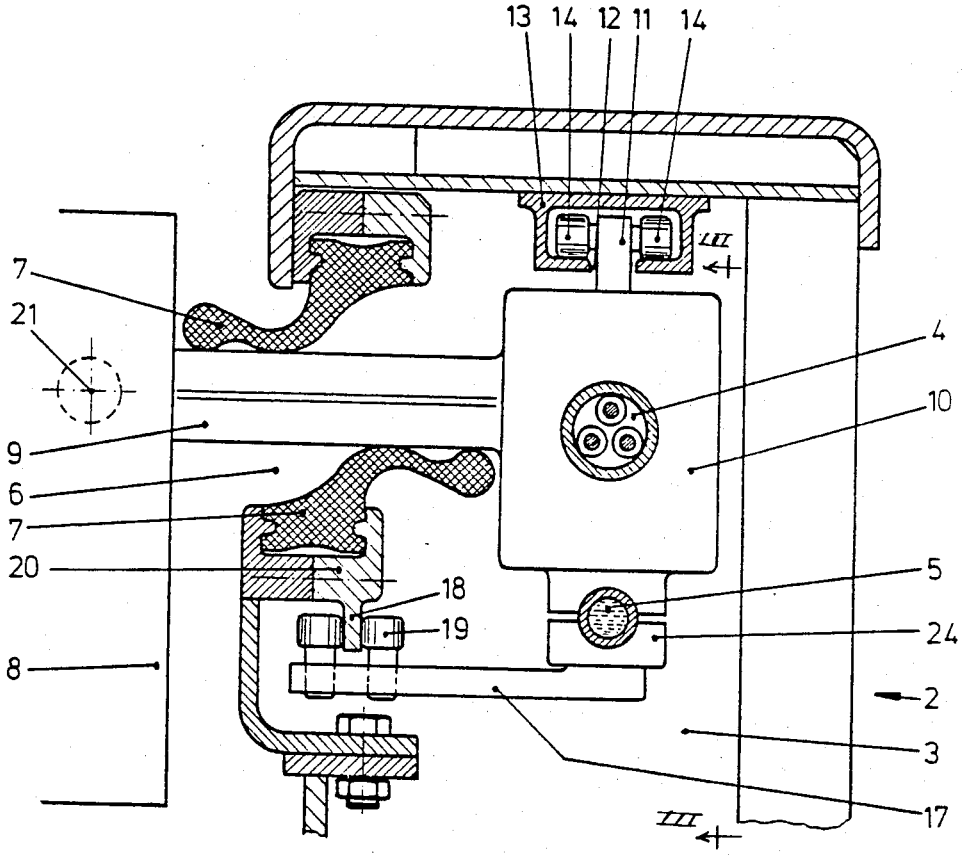
FIG. 2 is an enlarged cross-sectional view of a portion of the apparatus shown in FIG. 1.

With reference now to the drawings, and particularly to FIGS. 1 and 2, there is shown a face conveyor 1 for a long-wall mining machine which carries on its goaf-side a housing structure 2 which receives within its interior 3 a power supply cable 4 and a liquid supply conduit or hose 5. The left side of the housing structure 2, as shown in FIGS. 1 and 2, is formed by a face plate provided with an elongated slot 6 which extends along the course of travel of the mining machine, as does the housing 2 itself. Rubber strips 7 extend along the upper and lower edges of the slot 6 and are normally biased into engagement so as to close the slot 6 against the entry of mined material, debris, etc. A side arm 9 connected to a long-wall mining machine 8 movable along the face conveyor 1 extends through the slot 6 into the interior 3 of the housing structure 2. As can be seen in FIGS. 1 and 2, the side arm 9, as it moves along the housing structure 2, separates the two rubber strips 7 which immediately come together and close the slot 6 after the arm 9 passes. Carried on the outer end of the side arm 9, within the housing structure 2, is a junction box 10 about to be described.

In the embodiment of the invention shown in FIGS. 1–5, the junction box 10 is provided with two lugs 11 projecting upwardly from the top surface thereof. Lugs 11 extend through an elongated slot 12 (FIGS. 1 and 2) into a channel-shaped guide bar or track 13 secured to the top of the housing structure 2 within the interior 3 thereof. Each of the two lugs 11 carries two roller pairs 14 which are part of a trolley 15 (FIG. 5) movable along the track 13. The two trolleys 15 each have a pivot shaft 16 which extends transversely of the direction of machine movement and supports a link which carries the rollers 14. A lug 17 depends from the bottom of the junction box at the longitudinal center thereof and extends toward the aforesaid face plate having the slot 6 therein. The lug 17, in turn, carries rollers 19 which engage opposite side walls of a guide bar or track 18 which forms part of a strip 20 which secures the lower rubber strip 7 in place. A similar securing strip for the upper rubber strip 7 is provided, as shown. With the arrangement shown, it will be appreciated that the upper track 13 carries the weight of the junction box while the guide bar 18, which is below the slot 6 in the face plate of the housing structure 2, acts to guide the junction box laterally.

Figure 3:
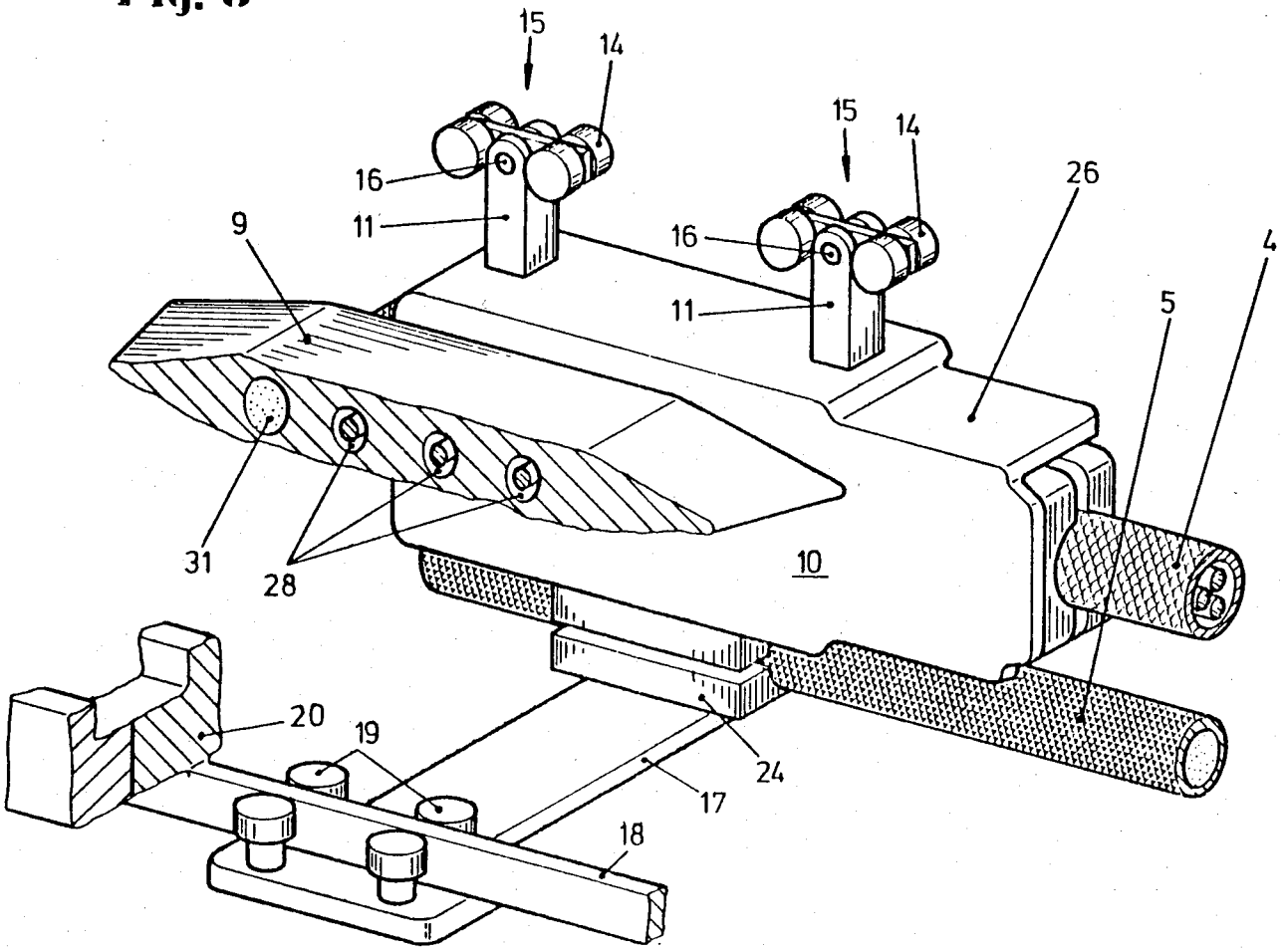
FIG. 3 is a partially broken-away side view, taken substantially along line III—III of FIG. 2, showing the interior of the junction box of the invention.
Figure 4:
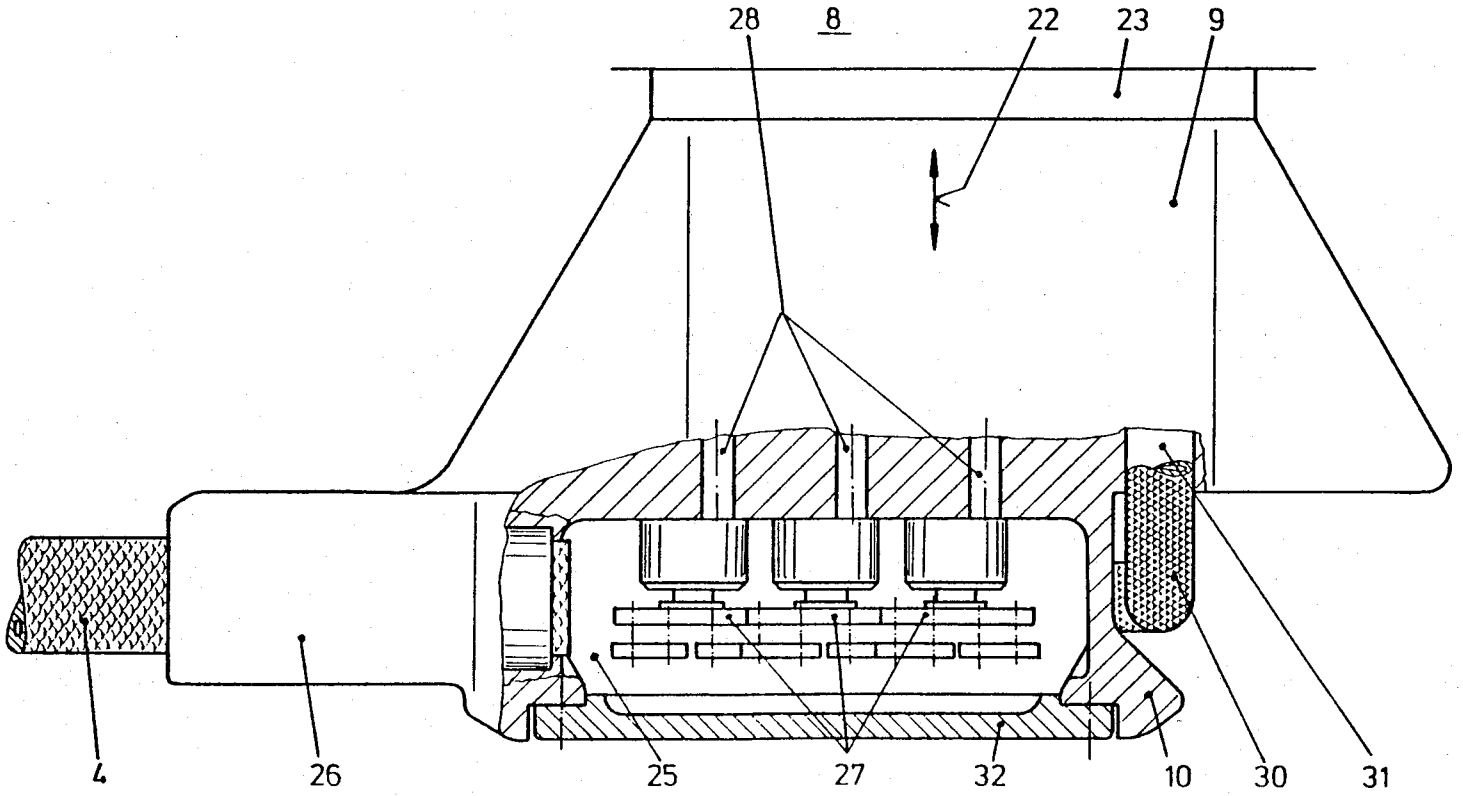
FIG. 4 is a partially broken-away top view of the junction box of the invention showing its connection to the aforesaid side arm.
Figure 5:
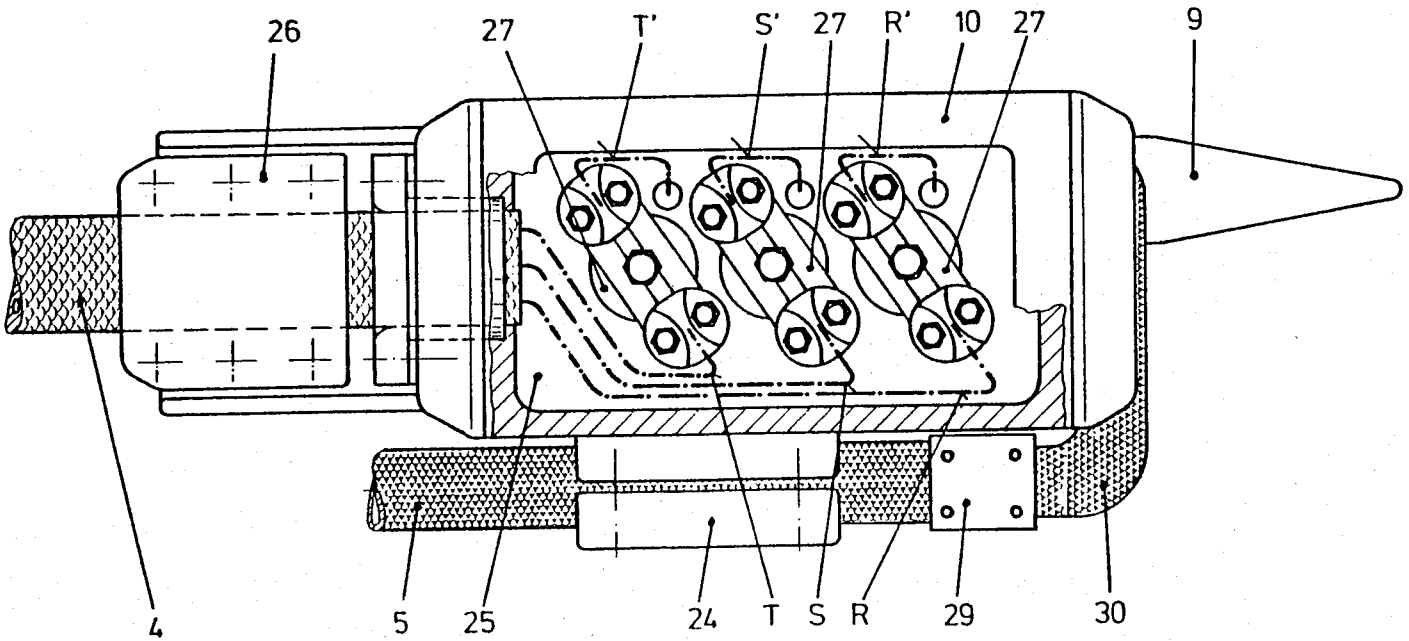
FIG. 5 is a perspective view showing the manner in which the junction box of the invention is guided within the housing structure.

The side arm 9, which carries the junction box 10, is pivotally connected to the mining machine 9 about a horizontal shaft 21 (FIG. 2) which extends parallel to the face conveyor 1 along the direction of machine movement. Additionally, and as is indicated in FIG. 4, the mounting of the side arm 9 to the mining machine 8 is such that it can reciprocate, along with shaft 21, transversely of the direction of machine movement as indicated by the double arrow 22 in FIG. 4. This feature completely obviates any strain on the junction box 10, which is retained by the tracks 13 and 18, due to up and down or in and out movement of the mining machine with respect to the housing structure 2. As is best shown in FIG. 4, the arm 9 is trapezoidal in configuration when viewed from above. Its longer side, which extends along the direction of machine movement, is connected to the junction box within the housing structure 2. Its opposite and shorter side merges into an arm section 23 which enters the body of the mining machine 8 and is supported therein for transverse movement and/or pivoting as described above. As is best shown in FIGS. 3 and 5, the two inclined end edges of the arm 9 which extend between the arm portion 23 and the junction box 10 are tapered. As the mining machine 8 moves along the face conveyor 1, these edges gradually force the rubber strips 7 out of the position in which they close the slot 6 extending along the housing structure 2.

The hose or liquid supply conduit 5 within the housing structure 2 is retained by a clamping element 24 (FIGS. 2 and 5) which, in turn, carries the lug 17. The power supply cable 4 extends into the interior 25 of junction box 10 (FIG. 3) through an aperture provided with a strain absorber 26. The strain absorber 26 extends around the end of the power supply cable 4 and is connected to the junction box 10 such that all tensile forces acting on the cable 4 are transmitted to the mining machine 8 via arm 9. As a result, the discrete conductors R, S and T of the power supply cable 4 extending out of the cable sheathing within the interior 25 are free from tension.

As shown in FIGS. 3 and 4, the conductors R, S and T are releasably connected to terminals 27 inside the interior 25 of the junction box 10. The terminals 27, in turn, are connected to conductors R′, S′ and T′ which extend through bores 28 (FIG. 5) in the side arm 9 and into the interior of the mining machine 8 where they are connected, at their opposite ends, to power supply terminals for the mining machine drive motor and other electrical parts. The conductors R′, S′ and T′ can be disconnected from the terminals 27 as can the conductors R, S and T. The hose 5, which is disposed outside the junction box 10, is releasably connected by means of coupling 29 (FIG. 3) to a hose portion 30 which extends through a bore 31 in arm 9 and into the interior of the mining machine 8. The junction box 10 can be closed by a cover 32 (FIG. 4) on the goaf-side of the box 10. In this manner, the terminals 27 within the interior of the junction box can be easily exposed by removing the cover 32. The cover 32 provides an airtight closure within the junction box and can be removed only when the cable 4 does not carry current.

Figure 6:
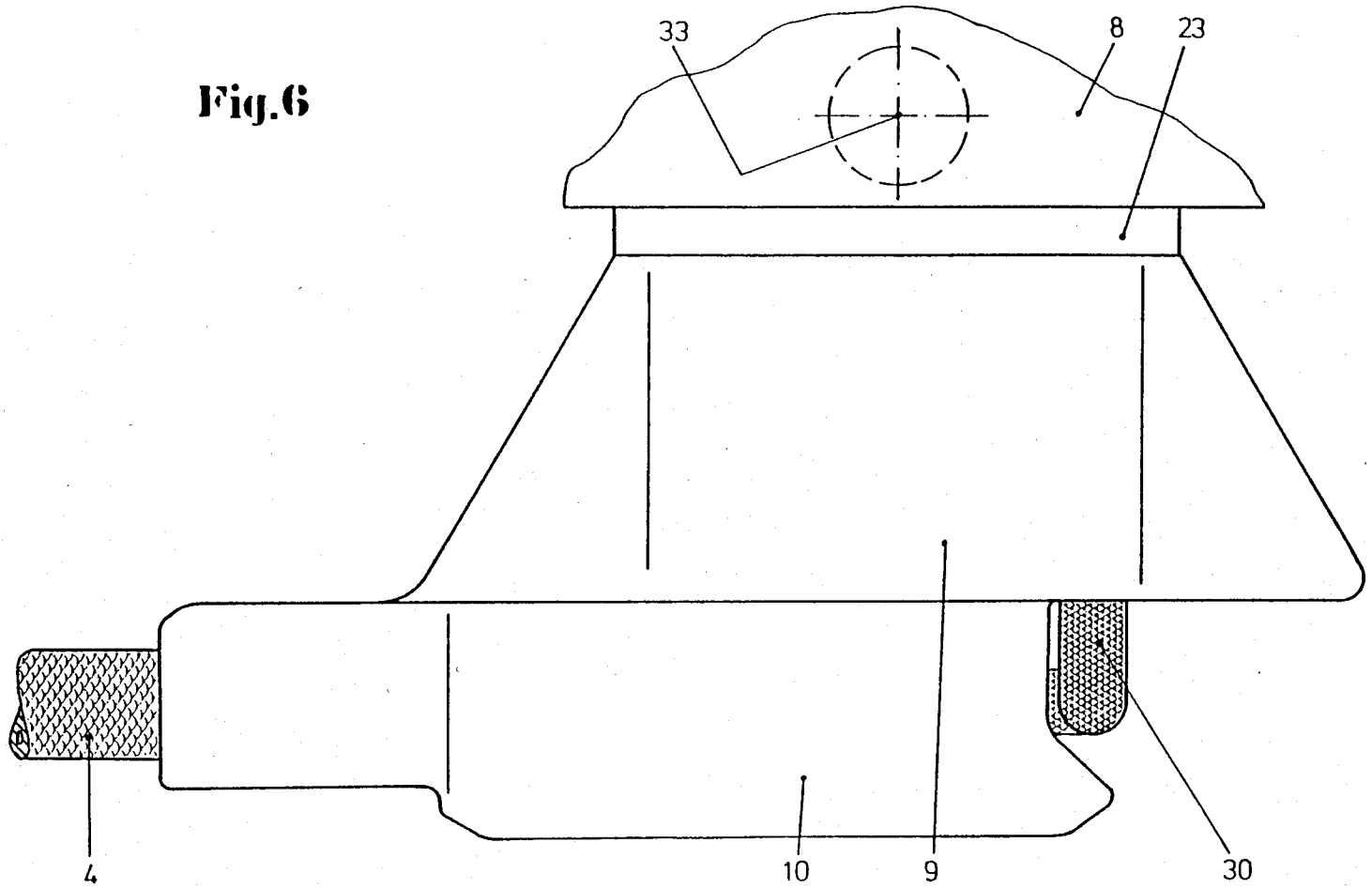
FIG. 6 is a top view of an alternative embodiment of the invention wherein the junction box is pivotally mounted on the side arm about a vertical axis.

An alternative embodiment of the invention is shown in FIG. 6 wherein elements corresponding to those of FIGS. 1–5 are identified by like reference numerals. In this case, however, the junction box 10 is not provided with guide elements within the housing structure but is retained and guided solely by the side arm 9 extending outwardly from the mining machine 8. In this embodiment, the arm 9 is mounted for pivotal movement about a vertical shaft 33 in the body of the mining machine. A limit switch or the like, not shown, responds to excessive pivoting of the arm 9 about the shaft 33 when the junction box 10 engages an obstruction or the like and stops the mining machine movement along face conveyor 1 so as to prevent damage to the junction box assembly.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a mining machine arrangement wherein a mining machine is adapted to traverse an elongated course of travel along a mine face, the combination comprising: a housing structure extending along the course of travel adjacent one side of the mining machine, the interior of said housing accommodating extended lengths of a power supply cable and a liquid supply conduit which are coextensive with at least a portion of the course of travel of the mining machine, said housing having a face plate provided with an elongated slot extending along the course of travel of the mining machine, a side arm mounted on the mining machine and extending through said slot, a junction box rigidly carried on an end of said side arm within said interior of said housing, junction means within said junction box for connecting power cable means leading from said mining machine to said extended length of power cable in the interior of said housing, and coupling means carried by said arm for coupling a liquid supply conduit leading from the mining machine to said extended length of liquid supply conduit in the interior of said housing structure, and said side arm being mounted on the mining machine for relative movement with respect thereto during traverse of the mining machine over its course of travel to facilitate guiding of said junction box within said interior of said housing.

2. The combination of claim 1 wherein said side arm is mounted on said mining machine for pivotal movement with respect thereto about a vertical shaft, said side arm being adapted to engage limit switch means when it pivots around said vertical shaft in response to engagement of said junction box with an obstruction within said housing structure, actuation of said limit switch means serving to stop said mining machine.

3. The combination of claim 1 including guide elements on said junction box which positively engage guide tracks extending within said housing structure.

4. The combination of claim 3 wherein said side arm is mounted on said mining machine for limited movement with respect thereto transversely of the direction of machine movement along the course of travel and for pivotal movement with respect to the mining machine about a shaft which extends parallel to the direction of the mining machine course of travel.

5. The combination of claim 4 wherein said guide elements include lug means extending upwardly from the top of said junction box, and roller means carried at the upper end of said lug means which engage one of said guide tracks.

6. The combination of claim 5 including a lug connected to the bottom of said junction box and extending transversely of the junction box, said lug carrying at its end rollers which engage a guide track extending along the length of said housing structure.

7. The combination of claim 1 including clamping means for securing to the bottom of said junction box said extended length of liquid supply conduit within the interior of said housing, said coupling means being interposed between said clamping means and said mining machine.

8. The combination of claim 1 including a closure member for said junction box which permits access to the interior thereof only when the power cable is deenergized.

9. The combination of claim 1 wherein said power cable means leading from the mining machine is in the form of discrete electrical conductors which extend through bores in said side arm to said junction box.

* * * * *